United States Patent [19]

Barorian

[11] 3,958,437

[45] May 25, 1976

[54] PROCESS FOR MANUFACTURING METAL POLES

[76] Inventor: Seew Barorian, reh. Ovadia, 6, Haifa, Israel

[22] Filed: Jan. 24, 1975

[21] Appl. No.: 543,940

[52] U.S. Cl. ..... 72/55; 72/62
[51] Int. Cl.[2] ..... B21D 26/08
[58] Field of Search ..... 72/55, 56, 62, 61, 58; 29/421 E, 421 R

[56] References Cited

UNITED STATES PATENTS

| | | | |
|---|---|---|---|
| 939,702 | 11/1909 | Jones | 72/56 |
| 2,037,795 | 4/1936 | Johnson et al. | 72/62 |
| 3,036,373 | 5/1962 | Drexelius | 72/56 |
| 3,182,392 | 5/1965 | Neal et al. | 72/56 X |
| 3,751,954 | 8/1973 | Ezra et al. | 29/421 E |

*Primary Examiner*—Milton S. Mehr

[57] ABSTRACT

A method for manufacturing metal poles from a tubular metal element consisting in arranging this latter in a mold cavity and deforming it by explosion. The mold cavity has shaped walls in accordance with the desired configuration of the pole. The explosion is produced inside the tubular element and is propagated to its walls by a liquid medium which fills the internal space of the tubular element. The employed tubular element has a length greater than that of the desired pole and after explosion the deformed tubular element is finished by cutting away the exceeding length.

1 Claim, 3 Drawing Figures

PROCESS FOR MANUFACTURING METAL POLES

BACKGROUND OF THE INVENTION

The present invention concerns a process for manufacturing metal poles particularly public illumination poles, and generally poles for electric transmission lines.

As is known, poles for such end uses have generally an upwardly tapered overall shape and consist of parts or elements each having usually a truncated conical configuration with its tapered upper end substantially equal in diameter to the flared lower end.

The manufacturing of such poles has been heretofore carried out either by hot or cold drawing of cylindrical tubes or by welding along respective generating lines truncated conical blanks positioned on suitable molds.

Both these methods mentioned above are however affected by an important drawback in that they are expensive owing to the relatively sophisticated equipment and large expense of skilled labor necessary for their performing.

SUMMARY OF THE INVENTION

It is an object of the present invention to overcome the drawbacks of the prior art processes by providing an improved method for manufacturing metal poles which does not require expensive equipment and can be carried out with minor involvement of skilled labor.

A further object of the invention is that of providing a method which allows an easy manufacture of metal poles of any required shape such as frustum of cone, frustum of pyramid with any desired number of sides of the base polygon, poles with scrolled side surface and so on.

According to the present invention a method is provided for manufacturing metal poles including the steps of shaping a mold cavity according to an outer configuration suitable for forming at least a pole segment, arranging a tubular metal element in said mold cavity, introducing inside said tubular element an explosive material and detonating said explosive material so as to deform by explosion said tubular element whereby it assume the configuration of said shaped cavity.

More particularly, the invention is directed to applying an explosion forming to the manufacture of poles, and specifically public illumination poles.

BRIEF DESCRIPTION OF THE DRAWINGS

The characteristics of the invention will appear more clearly from the following detailed description of an embodiment of the method for manufacturing poles given in connection with the accompanying drawings in which.

DESCRIPTION OF THE PREFERRED EMBODIMENT

Figure 1:
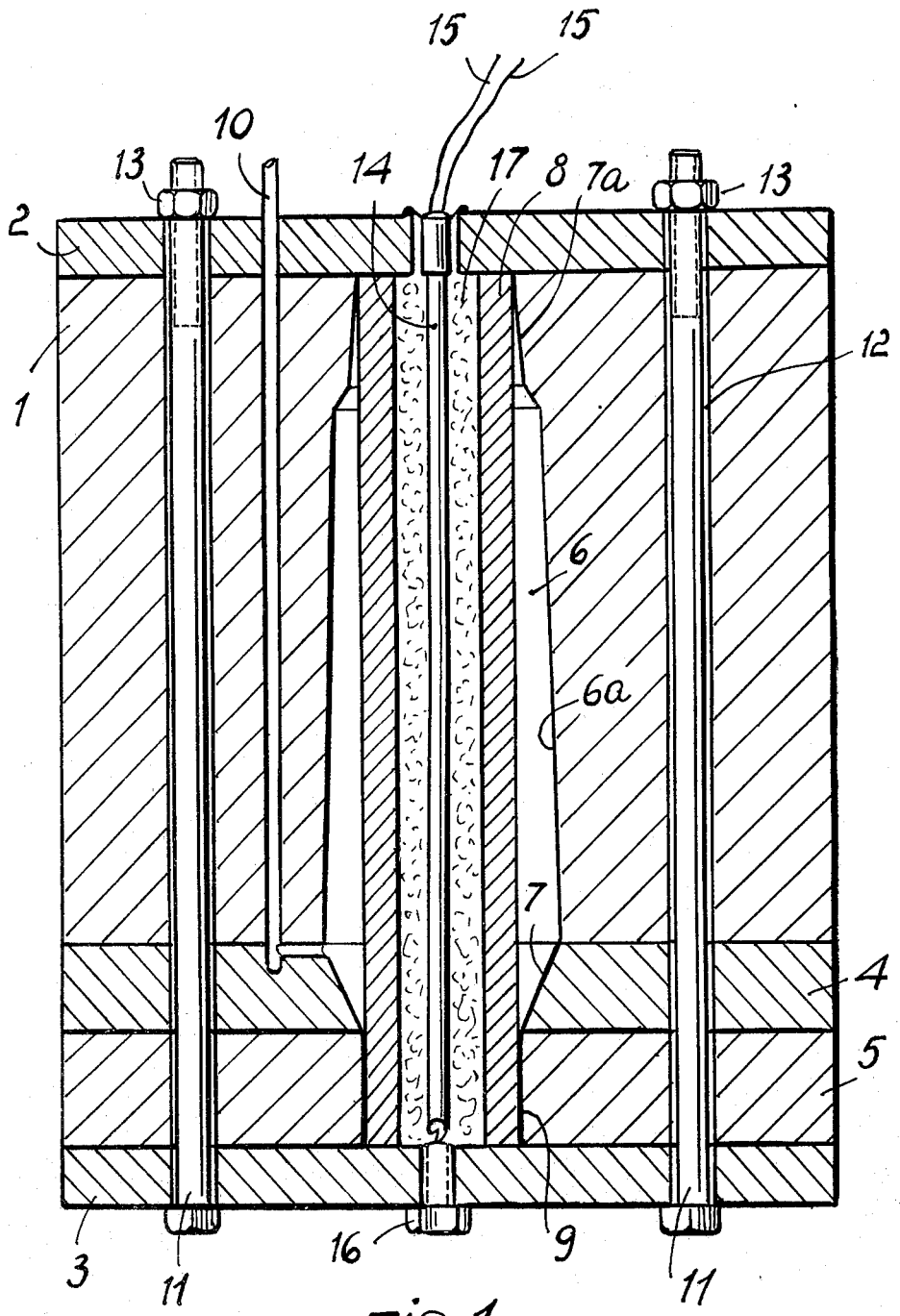
FIG. 1 shows a sectional view of a mold for carrying out the method of the invention, containing a tubular element located in the cavity thereof.

The method of the present invention consists essentially in deforming upon explosion a tubular metal element suitable to form at least a pole segment and thus located in an appropriate mold.

Both for the cases in which it is desired to produce poles or segments thereof, this invention relates to applying an explosion forming to the manufacture of such poles; if pole segments are formed, a step of the methods allows them to be assembled in consecutive alligned arrangement to form a finished metal pole having a height which is the sum of the heights of the component segments.

The mold useful in the present invention can have suitable shaped inner walls defining a shaped cavity and the explosion is induced inside the tubular element so that this element will assume the configuration of the shaped mold cavity.

The explosion produced inside the starting tubular element is advantageously propagated to the walls thereof by means of an appropriate medium which fills the internal space of the tubular element.

Although the propagation medium can be a gaseous or a liquid medium, a liquid one is preferred in order to avoid any risk possibly deriving from the high pressure involved in using gases.

Referring now to the drawings, the mold for practicing the invention comprises a mold body 1, preferably made of epoxy resins, an upper metal cover 2 and a lower metal cover 3.

Between the lower end of the body 1 and the cover 3 there are interposed in succession a base plate 4, also of epoxy resin matching, in assembled position, with the body 1 and a supporting plaque 5 matching at the top with the base plate 4 and at the bottom with the cover 3.

The body 1 defines innerly a mold cavity 6 having walls shaped according to the final configuration of conventional or desired poles or segments thereof, as arc used especially for public illumination. In the illustrated embodiment the cavity has a first central portion 6a of frusto conical configuration which extends with a downwardly tapering second portion 7 in the base plate 4 and presents upperly a third narrower tapered portion 7*a*.

The cavity 6 is arranged to house a tubular metallic element 8 constituting the starting piece for the manufacture of the pole segments. Although this element 8 can be of any desired shape, cylindrical tubes easily available in the commerce are usually preferred. The tube 8 which is to be deformed by explosion is firmly held in place at its lower end, being forced in a cylindrical cavity 9 defined as an extension of the second cavity portion 7 in the supporting plaque 5.

The mold cavity 6 is in communication with the outside of the mold through a channel 10 of small diameter, departing from the tapering portion 7 of the mold cavity and extending with a horizontal branch through the base plate 4 and then with a vertical branch through the body 1 and the upper cover 2. The channel serves for the removal of the gases present in the cavity 6 when explosion occurs, and in order to speed up such a removal, the outer end of the channel 10 is preferably connected to a vacuum pump (not illustrated).

The mold components are assembled and firmly held together by two bolts 11 extending along respective holes 12 which are formed by a plurality of hole portions provided respectively in the cover 2, body 1, base plate 4, supporting plaque 5 and cover 3, these hole portions being in axial alignment in the assembled position of the mold. The bolts are fixed by means of nuts 13. The bolts 11 are made of heavy-duty material in view of the great stresses created by the explosion occurring in the mold.

The explosive material located inside the tube 8 can be any of the ones conventionally used for deforming metal sheets, tubes and like, and is conveniently in the form of a cable 14 which can be detonated by a spark produced by electric conductors 15 located externally to the mold. Advantageously the explosive cable 14 is held in a taut condition, for example by drawing its lower extremity by means of a screw 16.

The tube 8 is filled with a liquid medium 17 which will propagate the shock wave of the explosion to the walls of the tube 8.

The practicing of the method of the invention is clearly apparent from the above description. Once the tube 8 is fixed at its lower end in the cylindrical cavity 9 of the supporting plaque 5, the mold is assembled and tightened by means of the bolts 11 associated to nuts 13.

Then the vacuum pump connected to the channel 10 is started for removing gases from the mold cavity 6, and an electric spark is produced by means of energizing the conductors 15, thus detonating the explosive cable 14. The explosion wave is transmitted through the liquid medium 17 to the walls of the tube 8 which are accordingly thrusted against the shaped walls of the cavity 6 assuming thereby the configuration thereof. The entire process so carried out is very simple and quick.

The pole segment obtained by the above process, after being removed from the mold is finished by cutting away its tapered portion corresponding to the second cavity portion 7 of the mold cavity 6. In this way a finished pole segment 18 is obtained which in the illustrated embodiment has a first portion 18*a* of frusto-conical shape constituting the prevalent portion of the pole segment 18 as illustrated in FIG. 2 and a second narrower portion 19 at the top of the first portion 18*a*.

The second upper portion 19 is joined to the first portion 18*a* through a connecting portion 18b defining a shoulder.

Figure 2:
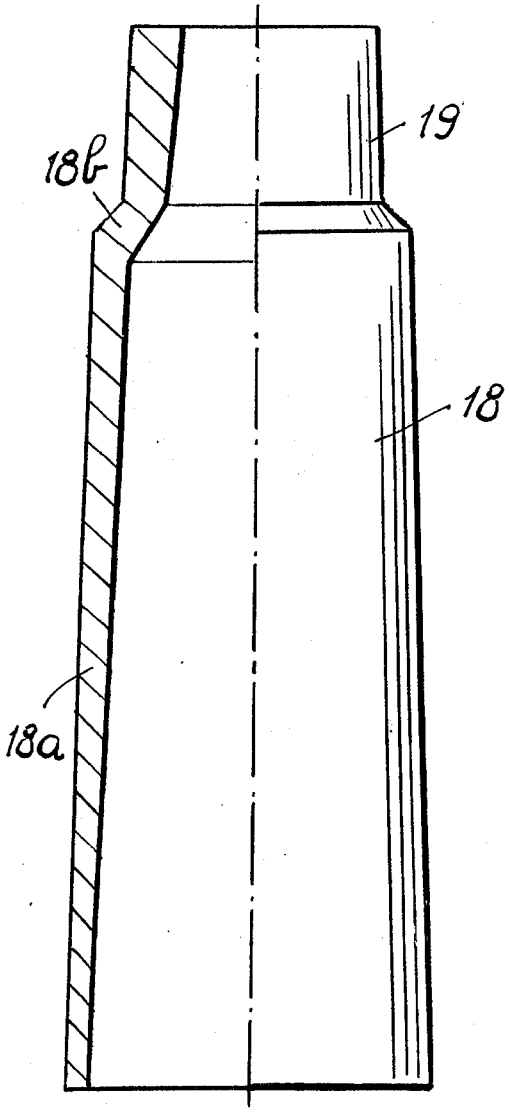
FIG. 2 is a partial sectional view, at a magnified scale, through a pole segment obtained with the method of the invention.

As visible in FIG. 2 the pole segment 18 obtained by explosion according to the present invention has the thickness of its walls varying as a function of its diameter, with the greater thickness corresponding to the minor diameter, i.e. to the minor deformation of the starting tubular element 8.

Thus the wall of the pole segment 18 has a greater thickness at the upper narrower portion 19 and the connecting portion 18*b* than at the first frusto-conical portion 18*a* of the pole segment.

By using series of molds or a mold with a plurality of cavities a series of pole segment can be obtained so that the external diameter of the upper narrower portion 19 of one segment, corresponding to the third cavity portion 7*a* of the mold cavity 6 is substantially equal to the internal diameter of the flared lower end of the next segment in the series.

Figure 3:
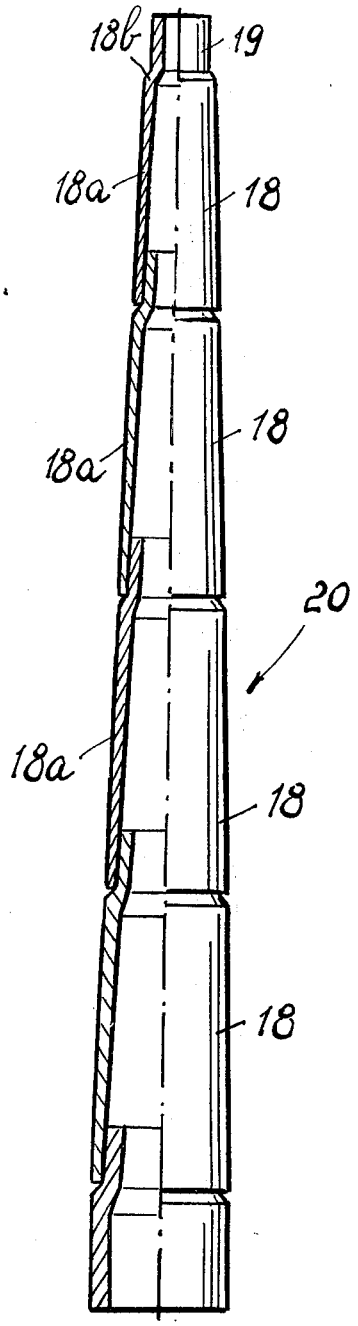
FIG. 3 is a partial sectioned view through a pole obtained by assembling together a series of pole segments manufactured by the method of the invention.

Thus, it is possible to assemble together the desired number of pole segments in a superimposed arrangement by simply forcing the narrower upper portion 19 of each segment into the flared base of the next segment placed upon the former. A finished pole 20 of the desired height is obtained as illustrated in FIG. 3. In this arrangement one segment of the finished pole rests on the shoulder defined by the connecting portion 18*b* of the underlying segment, the shoulder being advantageously conferred with improved strength owing to its greater thickness, as set forth above.

Whilst an embodiment of the invention has been described by way of illustration it will be clear to these skilled in the art that many variations may be made without departing from the scope of the invention as defined by the appended claims.

I claim:

1. A method for manufacturing metal poles, particularly public illumination poles, including the steps of shaping a mold cavity according to an outer configuration suitable for forming at least a pole segment, arranging a tubular metal element in said mold cavity, introducing inside said tubular element an explosive material and detonating said explosive material so as to deform by explosion said tubular element whereby it assumes the configuration of said shaped cavity, wherein said tubular element is arranged with its lower end fittingly received in an aperture of the mold and with its remaining length freely extending in a mold cavity axially aligned with said aperture; said cavity being shaped so as to define a main portion of prevalent length and a minor intermediate portion between said main portion and said aperture, said tubular element having an axial development greater than that of the pole to be obtained; and wherein a finishing step is provided, which comprises cutting away from the deformed tubular element a portion corresponding to said intermediate /portion of the mold portion and to said aperture of the mold.

* * * * *